United States Patent [19]

Czajkowski

[11] 4,447,059

[45] May 8, 1984

[54] PUTTING PRACTICE DEVICE WITH SPIRAL TRACK

[76] Inventor: Norman Czajkowski, 8815 Walnut Hill Rd., Chevy Chase, Md. 20015

[21] Appl. No.: 297,421

[22] Filed: Aug. 28, 1981

[51] Int. Cl.[3] ..... A63B 69/36

[52] U.S. Cl. ..... 273/176 FA; 273/176 B; 273/176 J; 273/179 R

[58] Field of Search ..... 273/184 R, 184 A, 176 B, 273/177 R, 179 E, 176 H, 195 A, 182 R, 182 A, 176 F, 176 FB, 87 R, 87 C, 176 J, 179 R

[56] References Cited

U.S. PATENT DOCUMENTS

| | | | |
|---|---|---|---|
| 1,818,700 | 8/1931 | Feltyberger | 273/184 R X |
| 2,157,023 | 5/1939 | Shannon | 273/176 B X |
| 2,456,322 | 12/1948 | Richardson | 273/180 |
| 2,609,199 | 9/1952 | Koener | 273/179 B |
| 3,215,436 | 11/1965 | Carter | 273/195 R X |
| 3,324,726 | 6/1967 | Turczynski | 273/181 D |
| 3,414,266 | 12/1968 | Mitchell | 273/195 A |
| 3,488,057 | 1/1970 | Fussell, Jr. et al. | 273/176 F |
| 3,601,407 | 8/1971 | Lorrance | 273/176 H |
| 4,211,417 | 7/1980 | Brown | 273/176 H |
| 4,222,568 | 9/1980 | Russo | 273/176 H |

*Primary Examiner*—George J. Marlo

*Attorney, Agent, or Firm*—Cushman, Darby & Cushman

[57] ABSTRACT

An apparatus for practicing golf putting strokes. The apparatus provides a generally direct correlation of the linear distance that a ball will travel and comprises a synthetic putting surface of sufficient roughness to achieve generally direct correlation of the linear distance of travel, and a spirally arranged wall member defining a spiral track along which a ball will roll; display numerals, corresponding to the linear distance that the ball rolls, may be provided on the spiral. The apparatus may be provided with a target simulating a portion of a regulation golf hole, riser members which vary the incline of the spiral track to simulate uphill or downhill putts (or combinations thereof), a ball return device which rotates above the spiral wall and sweeps the spiral track of balls which are resting thereon, and/or at least one removable obstacle.

32 Claims, 4 Drawing Figures

Fig. 6
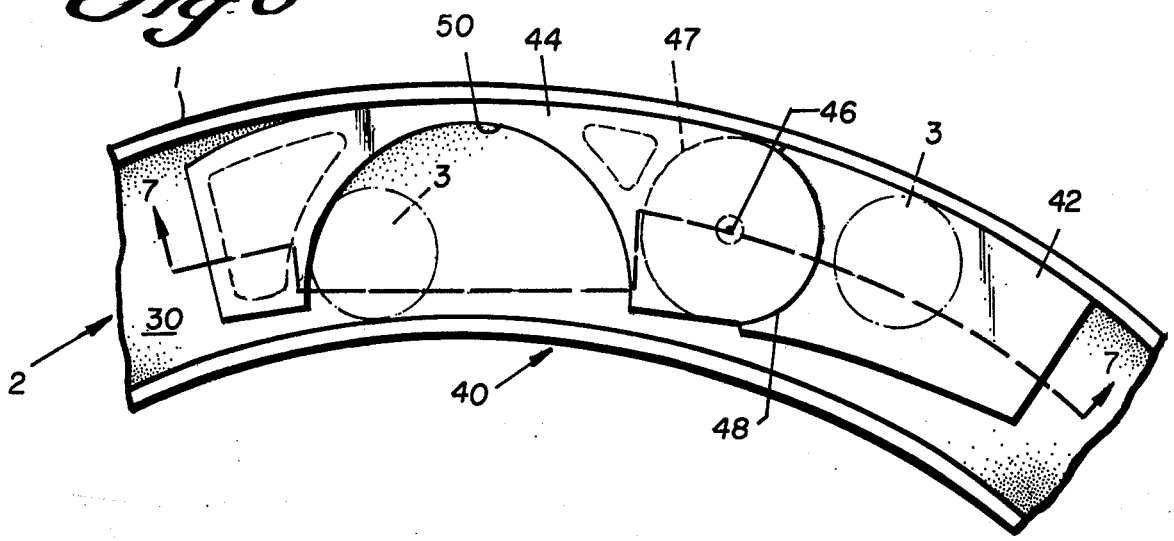
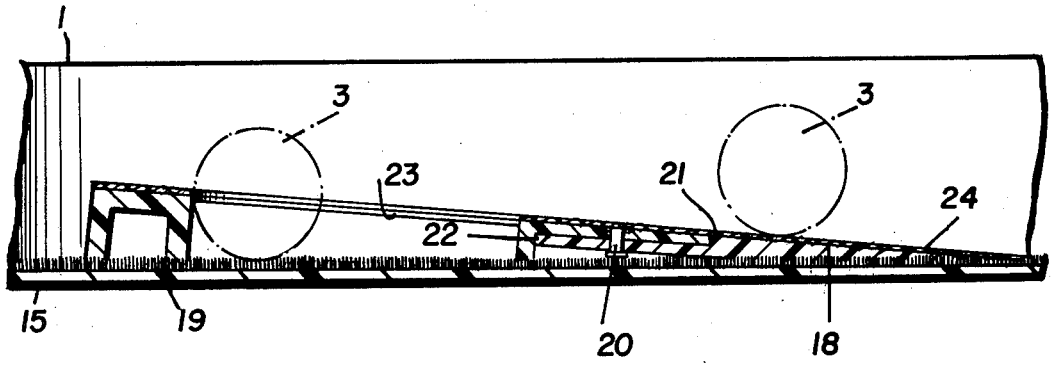
Fig. 7

PUTTING PRACTICE DEVICE WITH SPIRAL TRACK

BACKGROUND AND SUMMARY OF THE INVENTION

The score that the average golfer makes in a round of golf is greatly influenced by the number of strokes he takes on the green, that is, the number of putts necessary to place the ball in the golf hole. When faced with a long putt a golfer often may take three or more putts before he places the ball in the golf hole. Most golfers recognize that improved putting skill is one of the most expedient ways of reducing golf scores. The golfer's chief problem is not in hitting the ball in the proper direction, but in hitting it with sufficient force so that it will roll the proper distance. Consequently, golfers may spend many hours on rainy days and during the winter months practicing indoors using one of the many conventional putting practice assemblies available on the market.

Conventional putting practice assemblies may be devices such as a small carpet having an inclined ramp at one end where a hole or recessed cup is located. Alternately, the conventional putting device can be a special carpet having an array of rotatable pegs placed just beyond the path swept by a perfectly stroked putter, which if knocked over, identify an imperfect stroke of the putter. Another conventional type of putting practice device is one that returns golf balls automatically after they have been putted toward a target of some sort. All conventional putting devices, however, apply to the practice of rather short length putts under 12 feet in length.

Conventional assemblies have been proposed for use as game devices which incorporate a spirally arranged track, such as, those devices disclosed in U.S Pat. Nos. 1,818,700; 2,157,023; and 3,324,726. However, none of the conventional assemblies disclosed in these U.S. patents is capable of being utilized as a putting practice device which correlates linear distance to spiral distance as contemplated by the present invention.

As noted above, a golfer will need to practice substantially longer putts of larger than 12 feet, such as, putts of 25 to 40 feet in length, if noticeable improvement in his golf scores are to be realized. Should a golfer fail to place the ball in the hole on a long putt but strikes the ball to impart sufficient velocity to get it near the hole, he is virtually certain of reaching the golf hole in two putts, thereby reducing his stroke count for that hole by a minimum of one stroke. Thus, in an eighteen hole round of golf, a golfer could improve his golf score by a minimum of eighteen strokes.

The conventional assemblies noted above do not provide a golfer with the necessary distance to improve his putting when faced with a long putt. Thus, although certain conventional assemblies may provide a measure of practice for short putts, there is no practice for the substantially longer putts which a golfer often encounters in a round of golf.

The putting practice apparatus according to the present invention, however, offers a device by which an average golfer can improve his putting proficiency for substantially long putts. Thus, when a golfer is putting from long distances which would normally require too many strokes to place the golf ball into the hole, the present invention can provide a measure of practice for the long distance putts. The apparatus according to the present invention generally provides a spiral track and a rolling surface which has a predetermined roughness so that a correlation between the linear distance that a golf ball will roll upon a natural grain and the distance upon which the golf ball will roll along the spiral track of the present invention is achieved. The predetermined correlation between the linear distance and the distance which the golf ball will roll along the spiral track of the present invention is important to the golfer's putting stroke calibration, that is, the strength of the stroke necessary to impart sufficient velocity for a putt of a predetermined length.

The spiral track can have a material which has a sufficient roughness to translate into a direct one-to-one correlation between the linear distance and spiral distance or, can be of a material which is generally rougher than a natural putting green so that a less than one-to-one correlation is achieved thereby enabling a golfer to practice his putting strokes of even greater lengths of up to 80 feet or more. The apparatus according to the present invention can be used with several variations which simulate uphill and downhill putts as are often encountered in a round of golf. As such, the apparatus according to the present invention is quite useful as a teaching tool or as a promotional device for the sales of putters. It is presently contemplated that the apparatus according to the present invention can either be permanently installed in an indoor facility or readily assembled and disassembled for transportation or storage.

As will be discussed in more detail below, the apparatus according to the present invention can be provided with several features including a ball return feature, a target feature, or obstacles placed in the path of the spiral track for game purposes. In such assemblies, the present invention offers a wide variety of utilization suitable for the entire family of all age groups.

BRIEF DESCRIPTION OF THE DRAWINGS

FIG. 6 is a plan view of an exemplary target device utilizable with the putting track of the present invention;

FIG. 7 is a cross sectional elevation view of the target device depicted in FIG. 6;

DETAILED DESCRIPTION OF THE INVENTION

The invention, referred to as the Putting Practice Apparatus (PPA), is based on the principle that a straight line of given length, when coiled into a spiral, greatly reduces the amount of space required to contain that length. The PPA, therefore, is a device that essentially constrains a rolling golf ball to follow a spiral path rather than a straight line path. In one embodiment of the present invention, for example, long putts of over 40 feet can be practiced in a space of about four feet by six feet.

Figure 1:
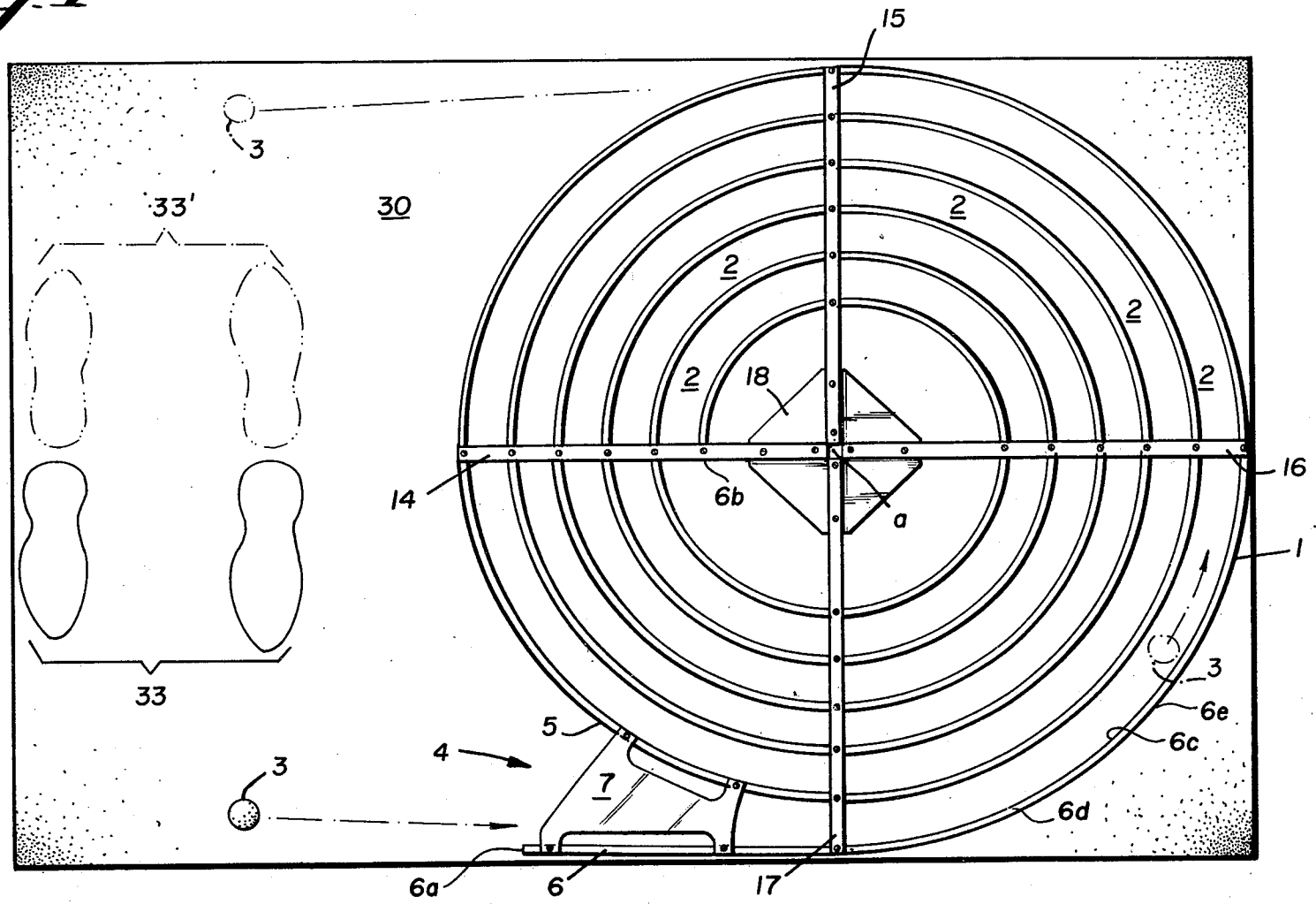
FIG. 1 is a plan view of an exemplary putting practice device according to the present invention.
Figure 2:
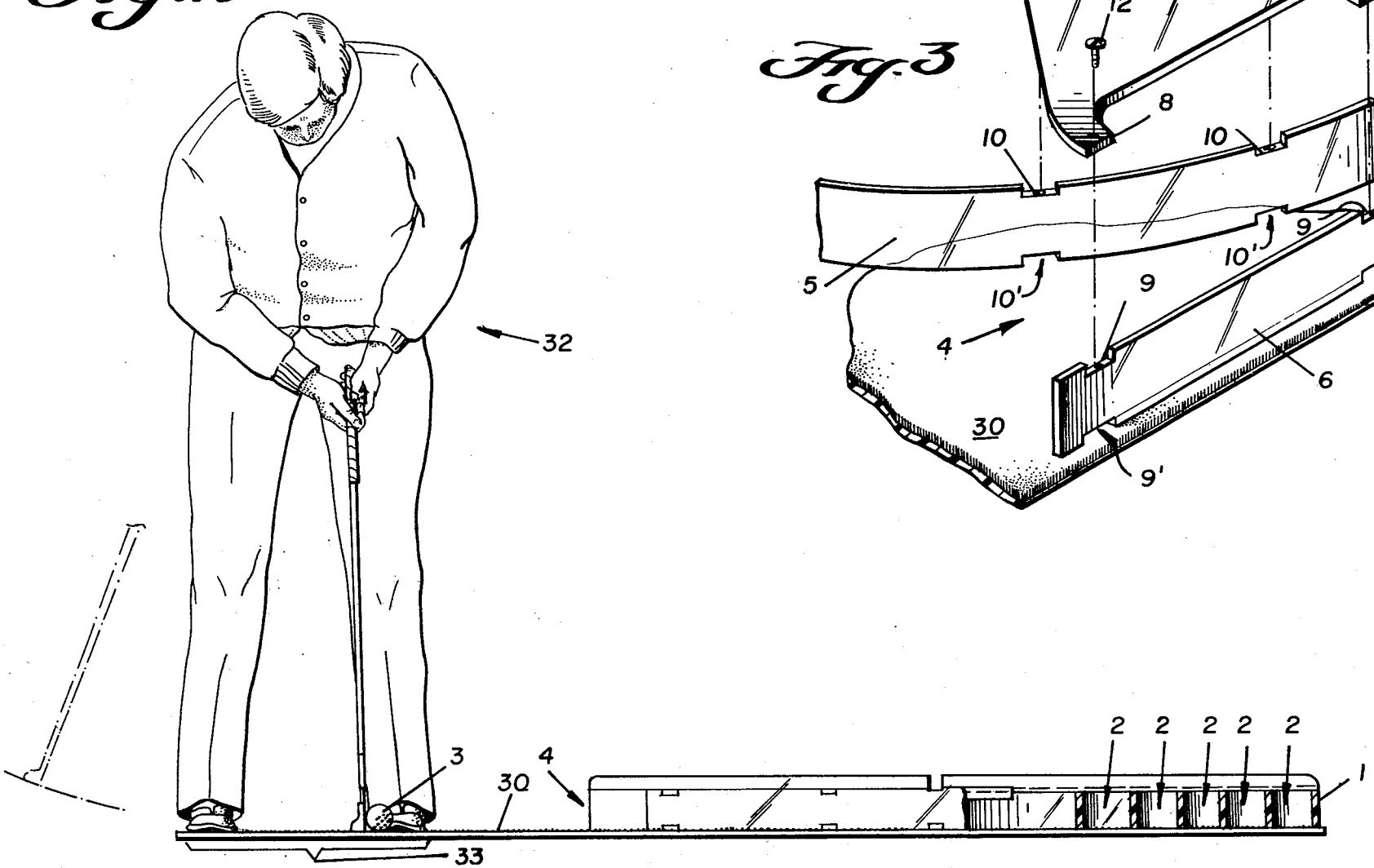
FIG. 2 is an elevational view partly in section of the embodiment depicted in FIG. 1.

A general arrangement of one embodiment of the PPA is illustrated in FIG. 1 and FIG. 2. The key element of the PPA is spiral 1 which is preferably a ribbon of hard clear plastic (e.g. Lucite) molded in the form of an Archimedes Spiral. The clear plastic assures that the ball is visible throughout its entire travel in the spiral. The geometry of this spiral is such that a point moving at constant velocity along the spiral from the inner coil to the outer coil rotates about a spiral origin or axis "a" at a constant angular velocity and along a radius that also increases at a constant rate. As the spiral is used in the PPA, the ball [or point according to the above definition] moves from the outer coil to inner coil. However, this uniformity of motion also applies, except that the radius decreases. The uniformity of geometry and motion inherent in the Archimedes Spiral is important to the correlation of spiral distance a rolling ball traverses, compared with the linear distance it would have rolled if it were not constrained to follow the spiral path.

The spacing between the coils of spiral 1 form channel 2, the width of which is significantly greater than the diameter of a golf ball 3 to allow for clearance and to accommodate for spurious bouncing of the ball. Also, the heiqht of the walls that form channel 2 is sufficient to contain such aberrent ball motion.

Figure 3:
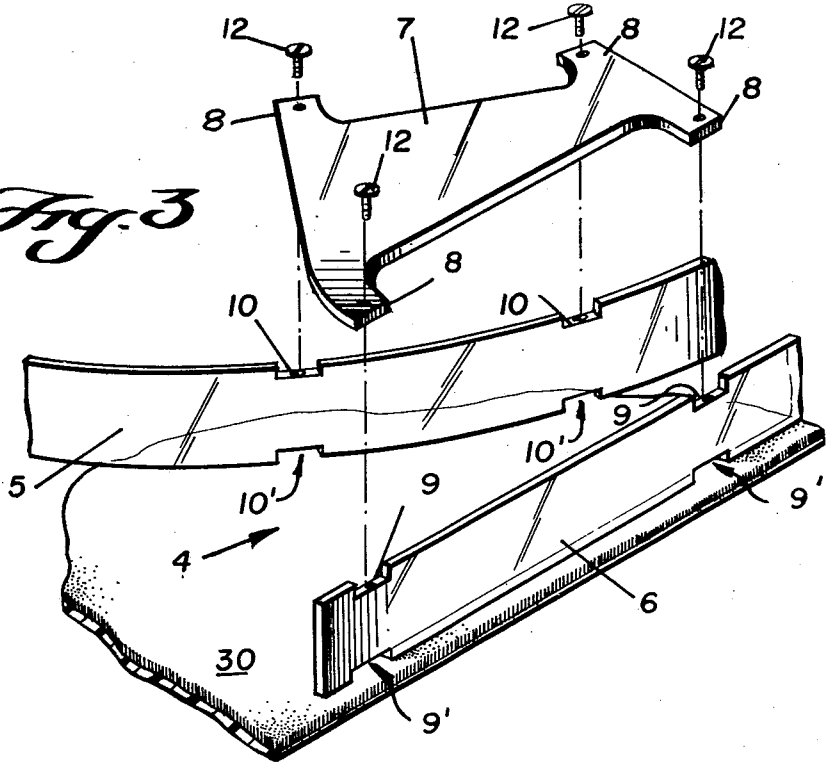
FIG. 3 is an exploded perspective view of the entrance to the putting practice device depicted in FIG. 1.

At its outermost coil, spiral 1 has an entrance 4. Entrance 4 is a converging opening formed by the wall 5 of the outer coil and the straight tangential wall 6 which is attached to and an integral part of spiral 1. Wall 6 has a front 6*a* (see FIG. 1), an end 6*b*, an interior surface 6*c*, a top portion 6*d*, and an exterior surface 6*e*. To help support wall 6, a clear plastic brace 7 ties tangential wall 6 to the spiral outer coil 5 as is more clearly shown in the exploded fragmentary view of FIG. 3. Tabs 8 in brace 7 fit snugly into slots 9 in tangential wall 6 and slots 10 in the spiral outer coil 5. Screws 12 securely fasten brace 7 to outer coils 5 and tangential wall 6.

The shape of the spiral is maintained by a framework consisting of spokes 14, 15, 16 and 17, and hub 18. The means by which this framework is assembled and attached to spiral 1 is illustrated more clearly in the exploded fragmentary view of FIG. 4, which shows a spoke 14 and a typical channel 12 of the spiral 1. Spoke 14 is preferably a U-shaped aluminum channel that fits snugly into corresponding slot 20 of hub 18 and is fastened to it by screws 12. Spoke 14 also fits snugly into slots 22, 23 in each of the coil walls 24, 25, respectively of spiral 1. Screws 26 securely fasten spoke 14 to spiral 1. Each of the four spokes 14, 15, 16 and 17 is the same in construction but differs in length and screw location to conform with the geometry of spiral 1. The longest is spoke 17 near spiral entrance 4 and the other three are assembled to hub 18 in decreasing order of length going counterclockwise around the spiral (e.g. 16, 15, 14). However, the location of screws 26 in spoke 14 and hub 18 is identical for all spokes. This commonality of screw location allows the PPA to be assembled for use by left-handed, as well as right-handed, golfers as will be described in more detail below.

To complete the PPA, the assembled spiral 1 is placed on a small green carpet 30 of certain surface roughness. The PPA could be used without carpet 30 by simply placing it on any household carpet. However, this use of the PPA would be without a precisely known correlation between spiral distance and linear distance noted above.

Figure 4:
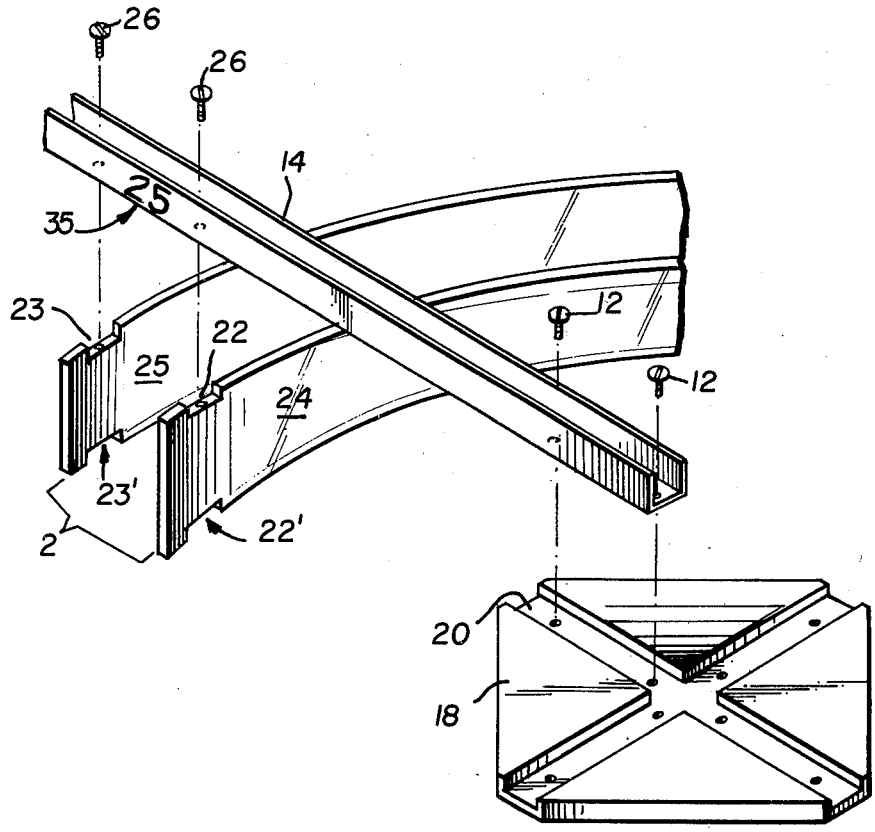
FIG. 4 is an exploded perspective view of the framework and hub of the device of FIG. 1.

The PPA is preferably used in the following way. The spiral assembly is placed on carpet 30 as shown in FIG. 1 to allow golfer 32 to take stance 33 in line with entrance 4 of the spiral 1. Golfer 32 decides upon a certain distance as his target. Distance markers 35 are printed in feet of distance on the outside surface of each leg of U-channel spokes 14–17 for this purpose, as shown in FIG. 4. Having this target in mind, golfer 32 then strikes ball 3 toward entrance 4. Ball 3, if struck with sufficient accuracy, will enter spiral 1 and roll in channel 2 always bearing against the outer wall. Ball 3 will roll this way until its kinetic energy is spent. At this point, it will come to rest after having traveled a spiral distance determined by the energy with which it was struck, and other factors associated with spiral motion and the frictional resistance on carpet 30 and the walls of spiral 1. The greater the energy with which the ball is struck, the greater will be its spiral distance of travel. And, assuming a one-to-one correlation between spiral distance and linear distance, the golfer, with practice, should become more proficient at lagging the ball close to the hole when faced with long putts in an actual game of golf.

Instead of using distance markers 35 as a target, a more realistic target can also be used. Such a target may be hinged cup 40 illustrated in FIGS. 6 and 7. It is preferable that this target be hinged in order to accommodate the different radii of outer and inner channels of spiral 1 into which it may be placed. Hinged cup 40 consists of two molded plastic parts, ramp portion 42 and cup portion 44. Both parts are held together by, and pivotable about, tubular rivet 46. Rivet 46 is crimped with sufficient force to create enough friction between ramp portion 42 and cup portion 44 to hold them in whatever pivoted position they may be placed. Also, these parts are configured to present generally a continuous planar surface for ball 3 to roll upon, and to intermesh with circular edges 47 and 48 to permit one part to pivot with respect to the other. Cup portion 44 has a semicircular opening 50 whose radius is preferably the same as that specified in the Rules of Golf for the size of the hole, i.e. 2⅛ inches. Opening 50 is located so that a properly struck ball after rolling up the ramp will drop into it. However, a ball struck too hard will catch the rim of opening 50 to spin off it and roll down channel 2. The degree of slope of ramp portion 42 is such that opening 50 is raised to a height approximately equal to the radius of the ball. This assures that a properly struck ball will fall into and be contained within opening 50. Finally, the top surfaces of hinged cup 40 are preferably covered with thin felt 24 (see FIG. 7) to provide necessary rolling friction.

A golf ball struck with a certain amount of energy will roll in a straight line with initial linear and rotational velocities in conformance with the physical law of conservation of energy. However, if the same ball were struck with the same amount of energy and immediately entered the PPA to roll in a spiral path, its velocities would be different than its corresponding velocities for linear motion even though the kinetic energy of the ball in both cases were the same. This velocity difference has the effect of causing the ball to roll a shorter distance in the spiral than it would have rolled had it followed a straight line. However, it is possible to compensate for this velocity difference and achieve generally a one-to-one correlation between spiral and linear distances.

Figure 5:
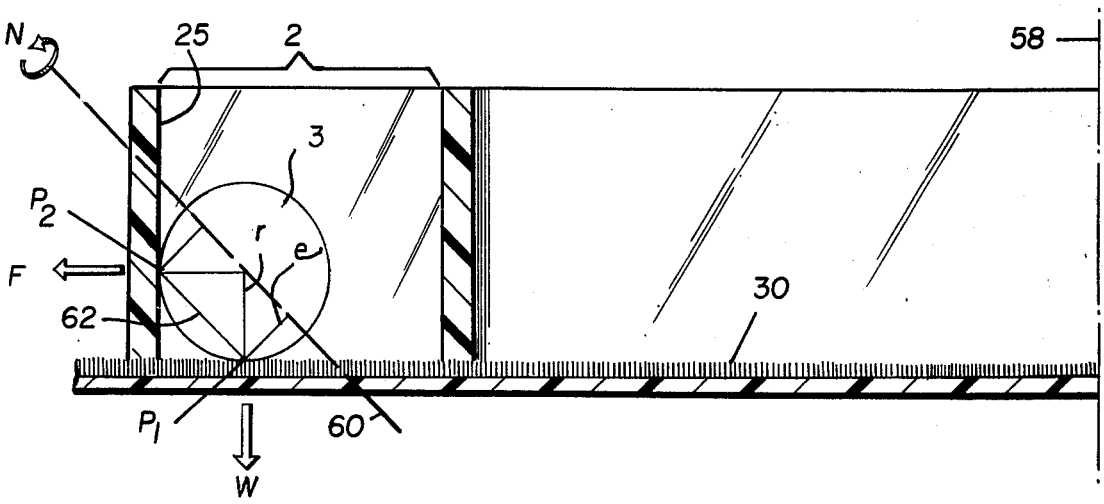
FIG. 5 is a partial sectional view showing a ball in rolling cooperation with the track of the device of FIG. 1.

Referring to FIG. 5, a brief explanation of the velocity difference is in order. A ball rolling in a straight line on a flat horizontal surface rolls on a radius equal to the radius of the ball. However, a ball constrained to roll in a spiral channel does not roll on that radius, as illustrated in FIG. 5. Ball 3 is shown rolling in spiral channel 2. It is rolling on carpet 30, contacting it at point P1, with a force W equal to the ball weight. In addition, centrifugal force F, generated as the ball revolves about spiral axis 58, causes the ball to bear against the outer wall 25 of channel 2 at point P2. Thus, while in the spiral the ball 3 is rolling on two points of contact, P1 and P2, rather than one as is the case for straight line horizontal surface rolling. Consequently, it is rolling about axis 60 which is a line through the center of the ball 3 and parallel to a line 62 joining points P1 and P2. Thus, in straight line motion on a horizontal surface the ball rolls on radius r, but in spiral motion it rolls on a shorter radius, e, and with rotational velocity N about axis 60. The net effect of this difference in rolling radii upon the motion of a ball is that it will actually produce a decrease in its horizontal velocity as the ball changes from a straight line path to a spiral path. The theoretical determination of the amount of this horizontal velocity loss depends primarily on the geometry of the spiral. The velocity loss of the illustrated embodiment, however, is in the range of about 12%.

Because of this velocity loss, the spiral distance a ball travels will be less than that of straight line travel, all other things being equal. However, this is true only if the rolling frictional resistance the ball encounters in straight line motion (i.e., on a natural grass putting green) and spiral motion are generally equal. This is the point where the surface roughness of carpet 30 comes into effect. By using a carpet 30 whose surface creates less rolling resistance than that of a natural grass putting green, it is possible to compensate for this velocity loss. In this way the generally one-to-one correlation between the distance traveled in the PPA and on the natural green can be approached. In the embodiment depicted, a smooth surfaced acrylic outdoor carpet 30 is used to approximate this one-to-one correlation.

As mentioned earlier, the PPA can be assembled for use by either right-handed or left-handed golfers. This is done in the following way. The illustrations of FIG. 1 and FIG. 2 show a right-handed assembly of the PPA with the golfer taking stance position 33. In this assembly the ball rolls counterclockwise as it makes it way from outer to inner coils of spiral 1. For left-handed use the golfer should take stance position 33' and the spiral channels 2 should be clockwise in orientation. Alternatively, a left-handed golfer could use a right-handed PPA. However, he would have to take a more undesirable stance off carpet 30 to do so. The ambidextrous design of the spiral assembly avoids this discriminatory use of the PPA. Left-handed assembly of the spiral 1 requires that the spiral be inverted from the right-handed assembly depicted in FIG. 1. To accomplish this, spiral 1 has slots 22' and 23' (see FIG. 4) that are opposite to and the same size as their companion right-handed slots 22 and 23. For left-handed use, spokes 14–17 are first assembled in a clockwise order of decreasing length, starting at the left-hand location of spiral entrance 4. The uniformity of slot 20 location and the location of screws 26 permit this change in order of spoke assembly. The assembled spokes 14–17 and hub 18 can be fastened to spiral 1 by placing the spokes in slots 22', 23' and fastening them with screws 26. To complete the assembly, tabs 8 and 9 of brace 7 are positioned with spiral 1 and tangential wall 6 in left-handed assembly slots 9' and 10', respectively, and secured with screws 12 (see FIG. 3).

Variations to Basic PPA

The PPA described above is the simplest version of the invention and it will be referred to hereafter as the Basic PPA. However, there are variations to this Basic PPA that offer different or additional capabilities.

1. Extended Distance or More Compact PPA

This variation is the same as the Basic PPA except for carpet 30. This embodiment uses a carpet having a rough surface rather than a smooth surface e.g. carpet with a deep pile. The rough carpet, which presents greater rolling resistance to the ball destroys the generally one-to-one correlation between spiral distance and linear distance previously discussed. However, the greater rolling resistance permits the simulation of longer putting distances in a spiral of a predetermined size. This embodiment additionally would permit the use of a smaller spiral for the same distance as the one-to-one correlation version offers. This variation can be used as a supplement to the Basic PPA, or where a smaller PPA is demanded by severe space limitations.

2. Uphill/Downhill Putt Simulation PPA

This embodiment is generally the same as the Basic PPA except that between its spiral walls it has a flexible spiral ramp on which the ball rolls, rather than a fixed level surface. By reason of its flexibility, the ramp can be positioned for level, uphill and downhill putts depending upon the type of putt the golfer wishes to practice.

Figure 8:
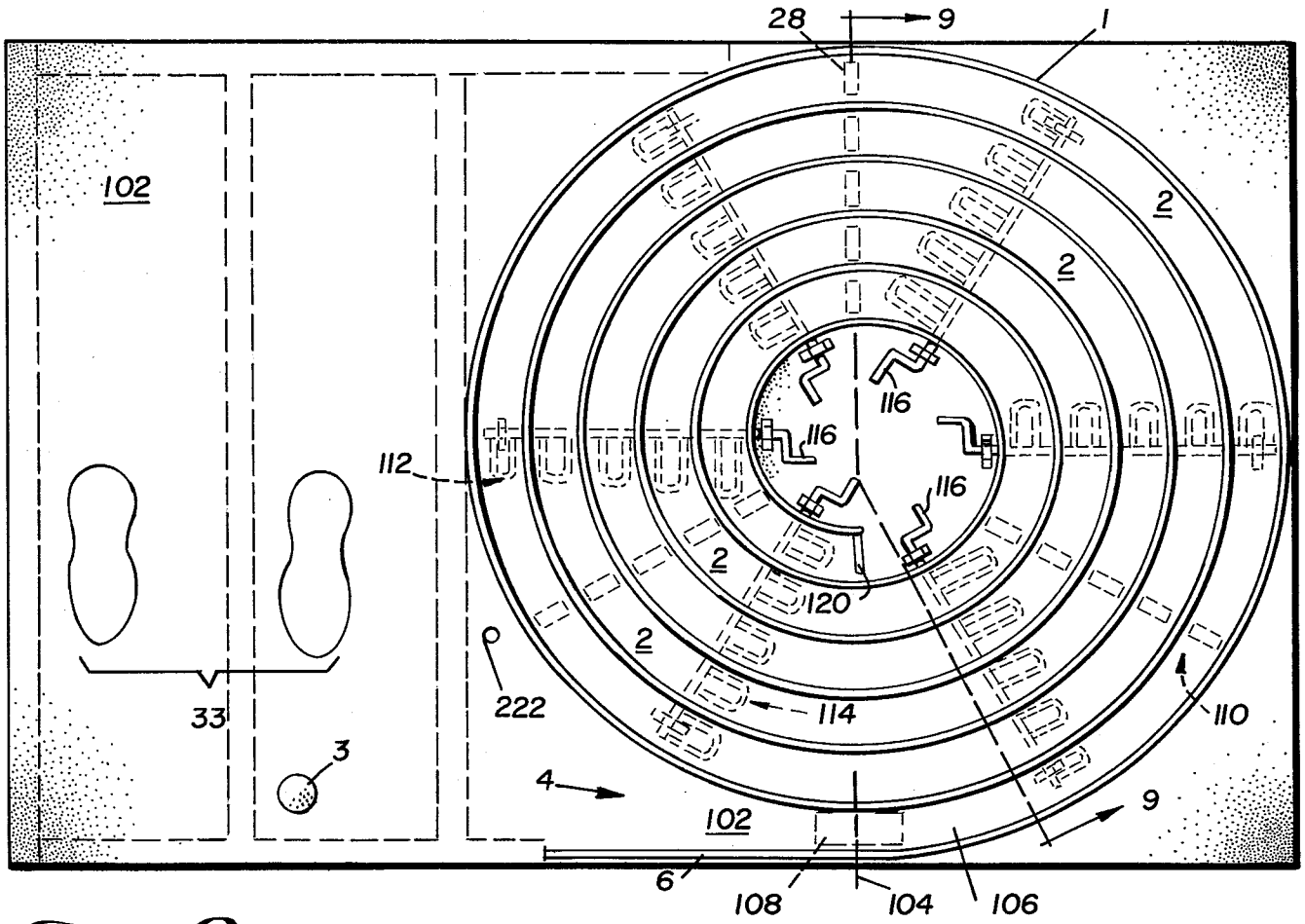
FIG. 8 is a plan view of an additional exemplary embodiment of the present invention.
Figure 10:
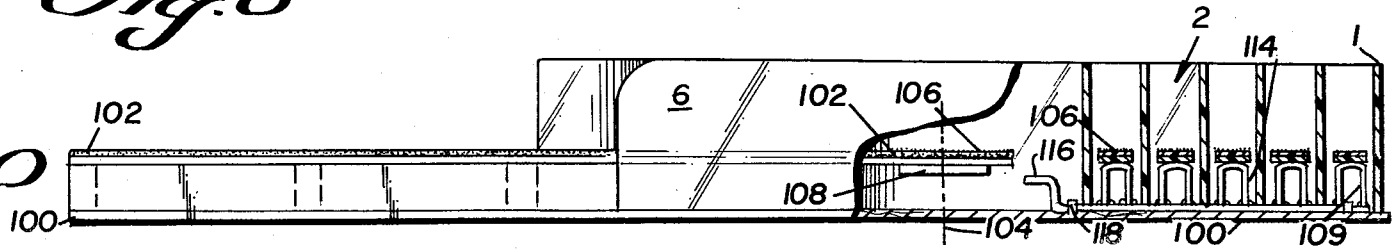
FIG. 10 is a right side elevational view partly in section of the embodiment depicted in FIG. 9.
Figure 9:
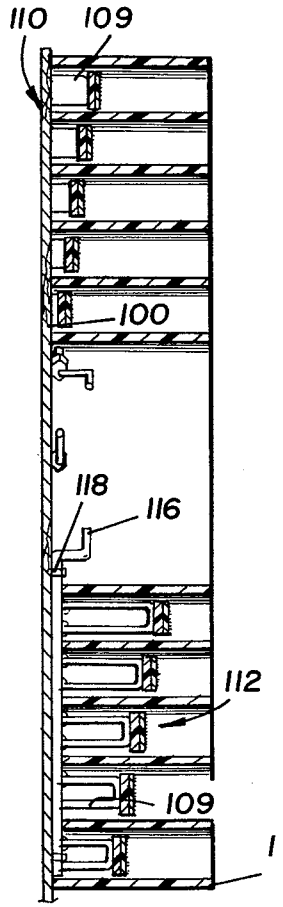
FIG. 9 is a cross sectional elevational view of the device of FIG. 8.

This embodiment of the PPA is illustrated in FIGS. 8, 9 and 10, and generally comprises a plywood base 100 to which clear plastic spiral 1 is firmly fastened. Attached to base 100 is a carpeted platform 102 which preferably stands about three inches above base 100. Platform 102 on which the golfer takes putting stance 33 is cut to match the outer coil of spiral 1 and extend into spiral entrance 4 to the axis of transition 104 between tangential wall 6 and spiral 1. At this point, one end of flexible spiral ramp 106, preferably made of plastic or fiberboard, is pivotably attached to platform 102 with riveted splice 108. The width of ramp 106 is slightly less than the space between the coiled walls of spiral 1 so as to be freely flexible in the vertical direction between these walls. Ramp 106 is preferably carpeted with similar material used on platform 102, i.e., smooth surfaced.

The amount of vertical flexure that ramp 106 assumes is governed by three sets of risers 110, 112 and 114. Each set preferably comprises a group of five riser members 109 and are equally spaced radially about the axis of the spiral. Risers 110 are preferably wooden blocks or similar structures glued to base 100 utilized for downhill putt simulation. Risers 112 are preferably formed from steel bars and welded to crank 116, are used for uphill putt simulation. Cranks 116 rotate in bearings 118 fastened to base 100. Risers 114 are constructed similarly to risers 112, but are formed to provide for level putts. It is possible with additional sets of risers to position ramp 106 for any combination of these three types of putts. Also, risers 112 and 114 could provide different degrees of downhill and uphill putts by means of a screw adjustable lift mechanism. At the end of ramp 106, in the innermost coil of spiral 1, barrier 120 is provided to prevent balls falling off the end of ramp 106.

In using this embodiment of the PPA, the golfer 32 first places ramp 106 in the position simulating the type of putt he wishes to practice. For level putts positions only the set of three risers 114 are placed into their vertical positions (see FIG. 10). Similarly, uphill putts can be simulated by positioning only the set of three risers 112 into the vertical position (see FIG. 9). For downhill putts, both sets of risers 112 and 114 are kept in the horizontal position allowing ramp 106 to rest upon risers 110. After setting the PPA according to the golfer's wishes, the golfer assumes stance 33 and strikes ball 3 into entrance 4 thereby proceeding to use the PPA in the same way described above for the Basic PPA.

3. PPA with Ball-Return Feature

Figure 11:
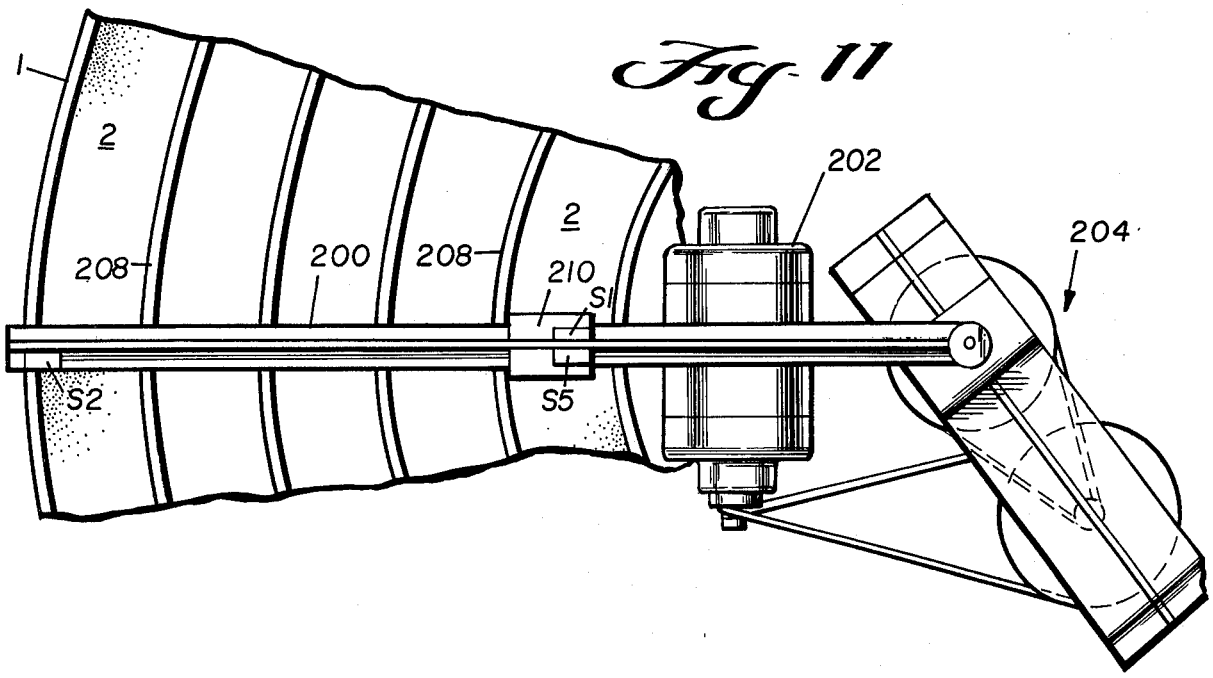
FIG. 11 is a plan view of a ball return device utilizable according to the present invention.
Figure 12:
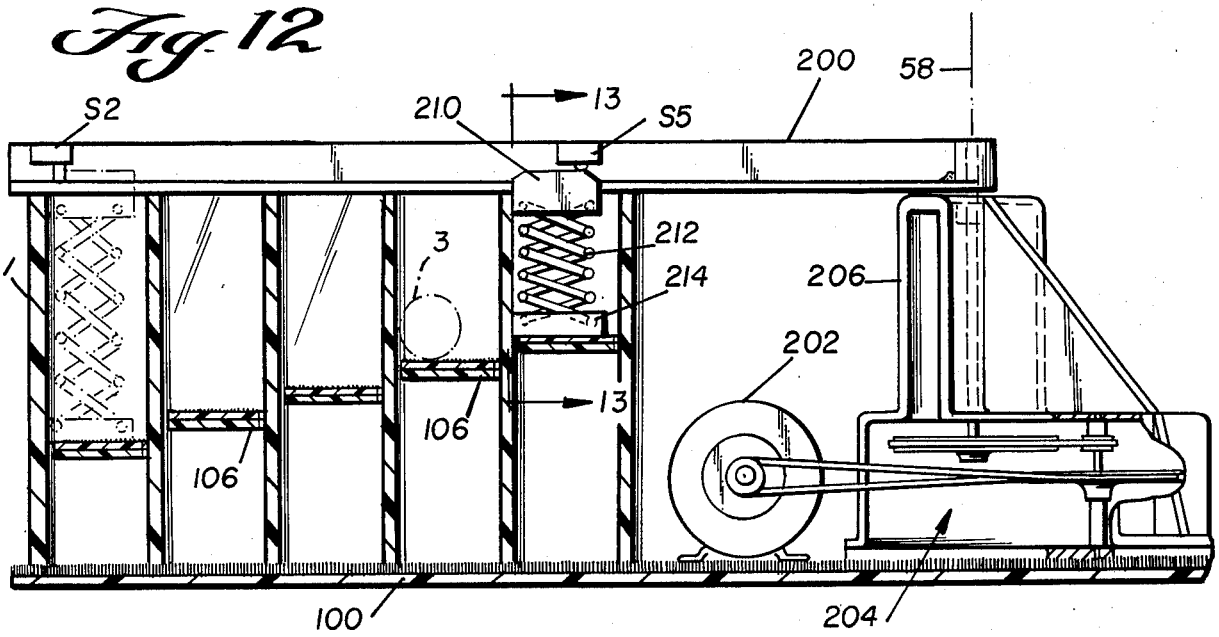
FIG. 12 is a partial cross section of the embodiment depicted in FIGS. 8 and 9 showing the ball return device associated therewith.
Figure 13:
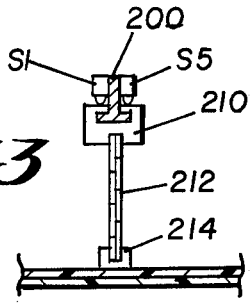
FIG. 13 is an elevational view of a ball sweeping member of the device of FIG. 12.

This embodiment of the PPA is preferably utilized in conjunction with the uphill/downhill putt simulation embodiment described above except it contemplates the addition of a ball-return feature. FIG. 11, FIG. 12, and FIG. 13 illustrate this ball return embodiment.

The ball return is a device that sweeps through spiral channel 2 from the inner coil to the outer coil thereby encouraging golf balls to roll before it and toward spiral entrance 4. The purpose of this embodiment is to eliminate the manual bending and picking up a golfer would normally do when making repeated practice putts on the PPA.

This embodiment preferably comprises an aluminum or plastic sweep-arm 200 that is driven to rotate about spiral axis 58 preferably by an electric motor 202 through a two-stage pulley and belt reducer assembly 204 contained in housing 206. Motor 202 and housinq 206 are fastened to base 100. Sweep-arm 200 slides along the top 208 of the coil walls of spiral 1 as it rotates. Also, sweep-arm 200 carries slide 210 which slides along the sweep arm and fits freely between the coil walls of spiral 1. Attached to slide 210, by means of linkage 212, is lower member 214 whose purpose is to sweep along ramp 106 encouraging golf balls to roll before it. The ability of linkage 212 to extend and collapse assures that lower member 214 will always sweep along ramp 106 regardless of the ramp's vertical position (i.e., for level, uphill or downhill putts). FIG. 12 illustrates linkage 212 behavior for the uphill putt simulation and as is shown in dotted line in the outer coil of spiral 1.

Figure 14:
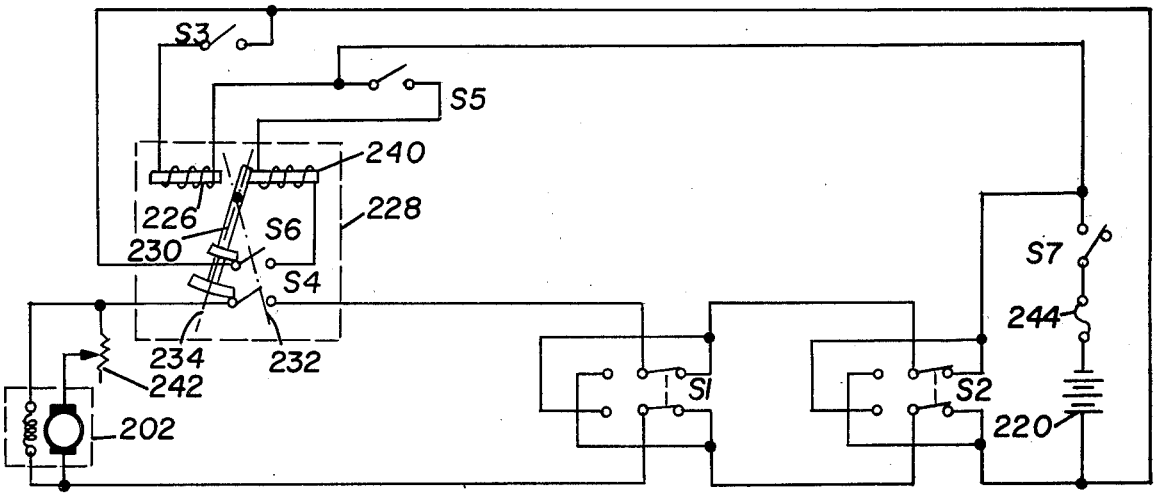
FIG. 14 is a schematic diagram showing a suitable control circuit for the automatic ball return device depicted in FIGS. 11 and 12.
Figure 15:
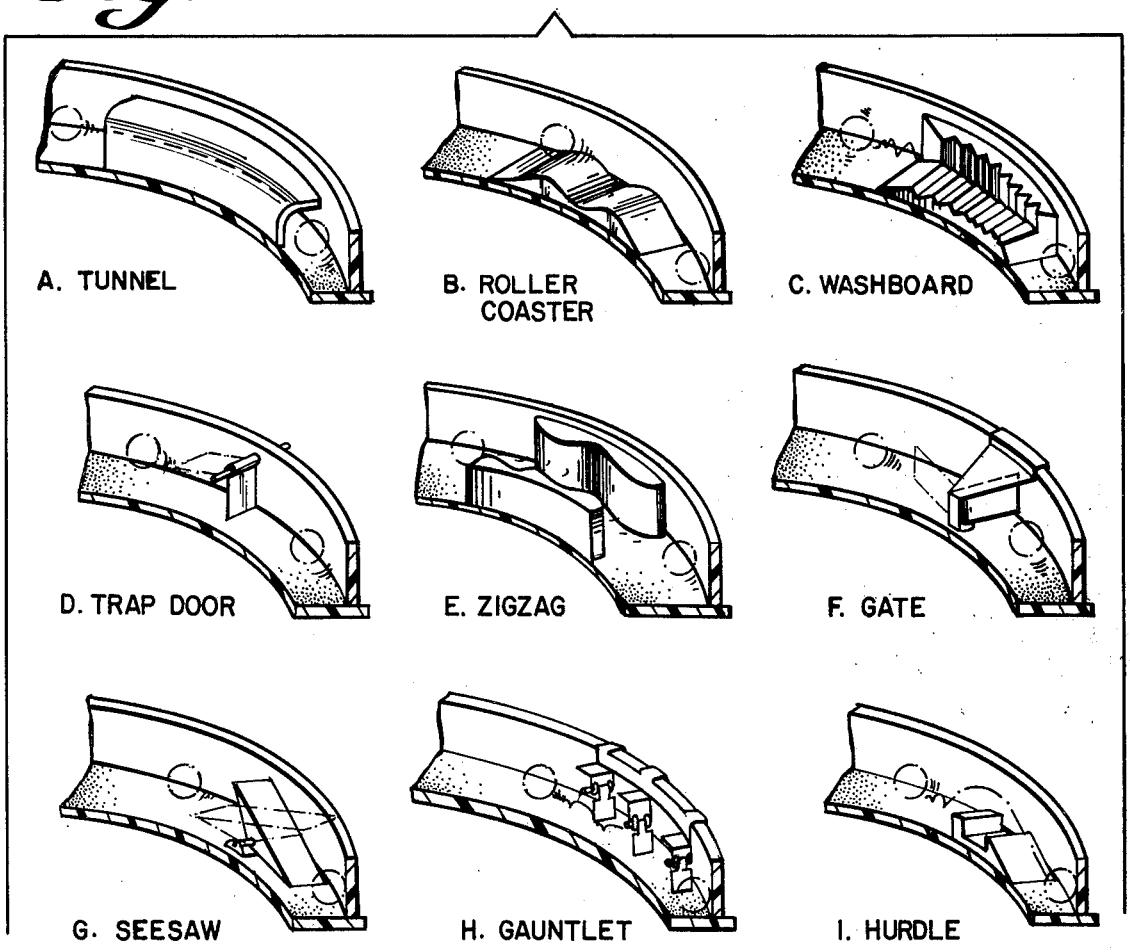
FIGS. 15A–15I illustrate a plurality of suitable obstacle components which may be utilized in conjunction with the device of the present invention.

The ball-return embodiment is preferably controlled by the golfer through an electric circuit that energizes motor 202. A variety of state-of-art circuits, either DC or AC, can provide this preferable means of control. An example of such a circuit, using DC energy, is illustrated in the schematic wiring diagram of FIG. 14. Battery 220 is the energy source for the circuit. Control of the circuit is obtained through the actions of switches S1 through S7. FIG. 14 shows all these switches in their normal or "start" position.

To operate the circuit, the golfer first closes main power switch S7, a single pole, double-throw switch. Subsequently, switch S3 is actuated by depressing a pedal (shown as 222 in FIG. 8) mounted in platform 102 with his foot. Pedal 222 is located sufficiently away from stance position 33 to avoid unintentional actuation of the ball-return assembly. Switch S3 is a normally open single pole, single throw switch that energizes one of the coils (i.e. coil 226 of solenoid 228). Solenoid 228 is preferably a double coil type with a spring toggle mechanism on its pivoting plunger 230 holding it in either of its two positions of actuation with a small bias force.

With the closure of switch S3, the solenoid 230 plunger will respond to the electromagnetic force of coil 226 which is sufficient to overcome the bias force and move from position 232 to position 234. Switches S4 and S6 close with this movement. Switch S6 readies the circuit for later actuation of coil 240, but switch S4 energizes motor 202. Motor 202 rotates sweep-arm 200 in a clockwise direction (for a right-handed PPA) causing slide 210 to move outwardly along the sweep-arm 200 in accordance with the geometry of spiral 1. In this way, slide 210 carries lower member 214 through the spiral channel 2 sweeping ramp 106 of golf balls to be returned.

At the outermost limit of travel of slide 210 where the lower member 214 delivers golf balls to spiral entrance 4, slide 210 actuates switch S2 fixed to sweep arm 200, thereby reversing the polarity of voltage supplied to motor 202. Switch S2 is a small double pole, double throw push button microswitch. In response to this polarity reversal, motor 202 rotates sweep-arm 200 in the counterclockwise direction and returns sweep-arm 200 and its slide 210 to the innermost limit of travel. At this limit, slide 200 closes switches S5 and S1 mounted on sweeparm 200 (see FIG. 13).

Both switches S5 and S1 are preferably microswitch. Switch S5 is normally open. Closure of switch S5 in conjunction with the previous closure of switch S6 actuates coil 240, moving the solenoid plunger 230 from position 234 back to position 232. With this movement, switch S6 opens to deenergize coil 240 and switch S4 opens to deenergize battery power to motor 202. Actuation of switch S1, which is the same as switch S2, returns the voltage polarity back to its normal or "start" polarity. At this point, the ball-return circuit has returned to its original condition at the start of its cycle with the exception of power switch S7. The circuit is now ready for another cycle of operation. When the golfer is finished using the PPA he simply opens switch S7.

The ball-return control circuit preferably has two other features. One is an adjustment in the speed of motor 202 by varying the resistance of its armature with rheostat 242. This speed adjustment permits the ball-return system to be used at its most effective speed. Also, the circuit preferably has an overload protective feature in the form of fuse 244. In the event that sweep-arm 200 were to jam, the consequent sudden rise in current will cause fuse 244 to open the circuit. In addition, the use of pulleys and belts as speed reducers also provide protection in this event. Thus, belt slippage would protect against mechanical damage to the system.

4. Toy or Game PPA's

Non-golfers, as well as golfers, could find amusement in using the PPA as a toy or game. One simple qame could take the following form. Along the entire length of the spiral channel, eighteen spots are marked by number. They need not be in sequential order. The game starts by placing hinged cup 17 on spot No. 1 thereby designating "Hole No. 1" of an eighteen hole round of golf. Two to four players may play the game. By random selection, they determine the one to play first, i.e. the player that has the "honor", and the order of play for the others. All players are given three golf balls. The player having "honors" takes his turn at trying to putt his first ball into hinged cup 17. If he "holes" this first ball, he need not use the other two balls. He has earned a score of "1" on that hole. If his first ball missed, but his second "holed", his score would be "2". And, his score would be "3" if he failed to "hole" the ball on the first two but "holed" the third. However, if he missed with all three balls he must take a mandatory score of "4". His fellow players, in turn, make their attempts at "holing the ball".

Upon completing Hole No. 1, the player taking the fewest tries at "holing the ball" wins that hole and has the "honor" of putting first at Hole No. 2. In other words, the determination of order of play follows the Honor Rule according to the Rules of Golf. Each of the eighteen holes is played in the same manner. The winner of the game is the player with the lowest total number of putts in "holing the ball" on all eighteen holes. Following the Rules of Golf, this method of scoring is known as Stroke Play. However, the game can also be played according to Match Play rules. In this case, the winner is the player having the lowest score on more of the holes than any of his fellow players.

There is another, more complex, game that can be played with the PPA. It is an obstacle game similar to the game of Miniature Golf. Marked along the length of the spiral channel are preferably nine spots onto which can be placed nine different putting obstacles. By using various combinations of these obstacles, a game of eighteen holes of golf can be played. FIGS. 15A–15I show a typical set of nine obstacles, and, Table I (below) illustrates how they may be combined to comprise eighteen holes of play. For example, to play Hole No. 2 obstacles A and B would be placed in their designated positions in the spiral channel and hinged cup 17 would be positioned in the channel just beyond these obstacles. The challenge facing the player is to strike the ball so that it successfully negotiates these obstacles and falls into hinged cup 17. Table I indicates the player should be able to "hole the ball" in two tries for hole No. 2 (i.e. par for this hole being "2"). This hole and all the others shown in Table I are scored in the same way as in the game described above. Other combinations may, of course, be utilized.

TABLE I

| Hole No. | Obstacle Composition | Par | Hole No. | Obstacle Composition | Par |
|---|---|---|---|---|---|
| 1 | A | 1 | 10 | E + F | 2 |
| 2 | A + B | 2 | 11 | E + F + G | 3 |
| 3 | A + B + C | 3 | 12 | F + G | 2 |
| 4 | B + C | 2 | 13 | G | 1 |
| 5 | C | 1 | 14 | G + H | 2 |
| 6 | C + D | 2 | 15 | G + H + I | 3 |
| 7 | C + D + E | 3 | 16 | H + I | 2 |
| 8 | D + E | 2 | 17 | I | 1 |
| 9 | E | 1 | 18 | None - Long putt of predetermined distance | 2 |
| | Total (out) | 17 | | Total (In) | 18 |
| | | | | Total Par (Out + In) | 35 |

While the invention has been herein described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and structures.

What is claimed is:

1. An apparatus for practicing golf putting strokes that provides a direct correlation between the distance that a ball will travel when struck by a player in using the apparatus with respect to a predetermined natural grass putting green said apparatus comprising:

a wall member having front and end portions, and interior and exterior surfaces, and adapted to be positioned upon a synthetic putting surface in an arcuate spiral arrangement about a centrally located vertical axis in such a manner that said wall member is spirally and successively coiled along a spiral path defined by the top portion of said wall member, said spiral path having a predetermined gradual decrease in radius as measured from said vertical axis as said wall member is coiled from said front portion to said end portion thereby defining a spiral track; said wall member further having a ball receiving portion receiving a ball struck by a player and directing the ball into said spiral track so that the ball will roll along said spiral track and be in a rolling relationship with said interior surface of said wall; and a synthetic putting surface having a surface roughness which is so different from the surface roughness of a natural grass golf putting green that a putted golf ball rolling upon said synthetic putting surface will have less velocity loss due to friction than a putted golf ball rolling upon said natural grass putting green whereby a putted ball will roll thereon in said spiral path substantially the same linear distance it would roll on said natural grass putting green.

2. An apparatus as in claim 1 wherein said ball receiving portion includes a wall extension having an interior and exterior surface which is generally tangential to said wall member at said front portion of said wall member so that said interior surfaces of said wall member and said wall extension are coextensive thereby enabling said rolling ball to roll onto said spiral track with negligible loss in velocity thereof.

3. An apparatus as in claim 1 further comprising display means for displaying distance numerals corresponding to the linear distance a ball rolls along said spiral track, said display means comprising a plurality of support members radially extending from generally said vertical axis and having at least one surface for displaying said distance numerals.

4. An apparatus as in claim 3 further comprising means for fixedly securing said support members to the top of said spirally arranged wall member at predetermined locations along the length thereof.

5. An apparatus as in claim 1 further comprising target means removably positioned a predetermined distance along said spiral track in the rolling path of a ball for providing a player a target at which to aim the ball so that sufficient velocity will be imparted by a player to the ball to enable the ball to roll along said spiral track and reach said target means at said predetermined distance.

6. An apparatus as in claim 5 wherein said target means comprises a generally planar ramp member having first and second generally opposite planar end portions and upwardly inclined in the direction of the rolling path of a ball such that said second end portion is disposed above said spiral track a predetermined distance and said first end portion is in a juxtaposed relationship with said spiral track to permit a rolling ball to roll upon said planar ramp member and be upwardly encouraged due to said incline thereof.

7. An apparatus as in claim 6 wherein said ramp member defines at least a partial arcuate opening into which a ball will roll if proper velocity is imparted thereto by a player.

8. An apparatus as recited in claims 1 or 5 wherein said wall member is of transparent material.

9. An apparatus as in claims 6 or 7 wherein said ramp member further includes pivot means for pivoting at least two portions of said ramp member so that said ramp member can be adjustable and adaptable for being removably placed upon said spiral track at predetermined locations thereon.

10. An apparatus as in claim 7 wherein said arcuate opening has a radius of about 2⅛ inches.

11. An apparatus as in claim 1 further comprising a generally planar platform surface mounted below said synthetic putting surface and vertically disposed a predetermined distance therefrom, and means mounting said synthetic putting surface to said platform surface of sufficient rigidity as to support the weight of a player standing upon said synthetic putting surface.

12. An apparatus as in claim 11 wherein said spiral ramp is composed of a flexible resilient material.

13. An apparatus as in claim 12 further comprising a plurality of elongated first riser members radially extending below said spiral track from generally the central area of said spirally arranged wall member, each of said first riser members comprising:

first means for turning said first riser member about its longitudinal axis; and a plurality of first cam members of predetermined different lengths fixedly mounted to said first riser member and being radially spaced a predetermined distance and decreasing in length from said central area along a transverse radial plane, so that each of said cam members is associated with a discrete portion of said spiral track as said track spirally increases in radius from said central area and so that a turning movement applied to said first turning means will cause said transverse plane to rotate to a generally vertical position thereby engaging said spiral track bottom with said first cam members and increasing the height of each discrete portion of said spiral track generally equal to the length of said first cam member associated therewith.

14. An apparatus as in claim 13 further comprising a plurality of elongated second riser members radially extending below said spiral track from generally the central area of said spirally arranged wall member, each of said second riser members comprising:

second means for turning said second riser member about its longitudinal axis; and a plurality of second cam members of predetermined generally uniform lengths fixedly mounted to said first riser member and being radially spaced a predetemined distance along a transverse radial plan, so that each of said cam members is associated with a discrete portion of said spiral track as said track spirally increases in radius from said central area and so that a turning movement applied to said second turning means will cause said transverse plane to rotate to a generally vertical position thereby engaging said spiral track bottom with said second cam members and increasing the height of each discrete portion of said spiral track generally equal to the length of said second cam member associated therewith.

15. An apparatus as in claim 12, 13 or 14 further comprising a plurality of third riser sets fixedly attached to the upper portion of said platform surface radially extending below said spiral track from generally the central area of said spirally arranged wall member, each of said third riser sets comprising a plurality of third riser members of predetermined successive different heights, each of said third riser members being associated with a discrete portion of said spiral track as said track spirally increases in radius from said central area so that said discrete portions of said spiral track will rest upon the tops of each of said third riser members thereby successively increasing the height thereof as said spiral track increases in radius length from said central area.

16. An apparatus as in claim 1 further comprising:

an elongated sweep arm member radially extending over the top of said spirally arranged wall member having opposite pivot end and free end portions;

motor means operatively connected to said pivot end portion for providing a predetermined normal turning direction of movement to said sweep arm in generally a horizontal plane generally about said central vertical axis of said spirally arranged wall member; and ball return means slidingly coupled to and extending below said sweep arm between for returning balls which have come to rest upon said spiral track so that when said sweep arm member is turned by said motor means, said ball return means follows the path of said spiral track thereby forcing a ball to roll in the advance thereof and to exit at said ball receiving member.

17. An apparatus as in claim 16 wherein said ball return means further comprises:

an upper member slidingly coupled to said sweep arm member for sliding movement along a predetermined longitudinal portion of said sweep arm member;

a lower member in communication with said spiral track for contacting a ball which comes to rest thereon and for encouraging said ball to roll in advance of said lower member due to the rotation of said sweep arm member; and linkage means for coupling said upper and lower members and for varying the distance between said upper and lower members so that said lower member will be in communication with any variation of contour of said spiral track.

18. An apparatus as in claims 16 or 17 further comprising:

first switch means located on said sweep arm member for limiting the sliding travel of said ball return means and said sweep arm member at an extreme predetermined first position thereon between said pivot end and said free end; and second switch means located on said sweep arm member for limiting the sliding travel of said ball return means on said sweep arm member at a predetermined second position thereon between said first position and said pivot end.

19. An apparatus as in claim 18 further comprising circuit means electrically coupled to said motor means for controlling the turning movement of said sweep arm member, wherein said circuit means comprises:

source means for supplying a source of electrical energy to said motor means;

means coupled to said first switch means for reversing the turning direction of said motor means from said normal predetermined turning movement in response to operative engagement of said ball return means with said first switch means; and main switch means for electrically coupling said source means to said motor means.

20. An apparatus as in claim 19 further comprising speed control means electrically coupled to said motor means for controlling the rate of turning movement of said sweep arm.

21. An apparatus as in claim 19 further comprising:

means coupled to said second switch means for deactivating said motor means in response to operative engagement of said ball return means with said second switch means; and means coupled to said second switch means for returning said motor means to said normal predetermined turning direction of movement in response to operative engagement of said ball return means with said second switch means.

22. An apparatus as in claim 17 wherein said linkage means comprises a scissor type linkage.

23. An apparatus as in claim 1 further comprising at least one obstacle means removably positioned on said spiral track in the rolling path of said ball for providing an obstacle to said ball when rolled along said spiral track.

24. In combination with a spiral track having a bottom, a target means for removable positioning a predetermined distance along the spiral track in the rolling path of a ball struck by a player to provide the palyer with a target at which to aim the ball, said target comprising: a generally planar ramp member having first and second generally opposite planar end portions upwardly inclined in the direction of the rolling path of the ball such that said second end portion is disposed above the spiral track bottom a predetermined distance and said first end portion is in a juxtaposed relationship with the spiral track bottom to permit a rolling ball to roll upon said planar ramp member; and wherein said ramp member defines at least a partial arcuate opening into which a ball will roll if proper velocity is imparted thereto by a player.

25. An apparatus as in claim 24 wherein said ramp member further includes pivot means for pivoting at least two portions of said ramp member so that said ramp member is adjustable and is removably placable upon said spiral track bottom at predetermined locations thereon.

26. An apparatus as in claim 24 wherein said arcuate opening has a radius of about $2\frac{1}{8}$ inches.

27. An apparatus for automatically returning balls which have come to rest upon a spirally arranged track comprising:

an elongated sweep arm member radially extending over the top of said spirally arranged wall member having opposite pivot end and free end portions;

motor means operatively connected to said pivot end portion for providing a predetermined normal turning direction of movement to sid sweep arm in generally a horizontal plane generally about said central vertical axis of said spirally arranged wall member; and ball return means slidingly coupled to and extending below said sweep arm for returning balls which have come to rest upon said spiral track so that when said sweep arm member is turned by said motor means, said ball return means follows the path of said spiral track thereby forcing a ball to roll in the advance thereof and to exit at said ball receiving member.

28. An apparatus as in claim 27 wherein said ball return means further comprises:

an upper member slidingly coupled to said sweep arm member for sliding movement along a predetermined longitudinal portion of said sweep arm member;

a lower member in communication with said spiral track for contacting a ball which comes to rest thereon and for encouraging said ball to roll in advance of said lower member due to the rotation of said sweep arm member; and linkage means for coupling said upper and lower members and for varying the distance between said upper and lower members so that said lower member will be in communication with any variation of contour of said spiral track.

29. An apparatus as in claims 27 or 28 further comprising:

first switch means located on said sweep arm member for limiting the sliding travel of said ball return means and said sweep arm member at an extreme predetermined first position thereon between said pivot end and said free end; and second switch means located on said sweep arm member for limiting the sliding travel of said ball return means on said sweep arm member at a predetermined second position thereon between said first position and said pivot end.

30. An apparatus as in claim 29 further comprising circuit means electrically coupled to said motor means for controlling the turning movement of said sweep arm member, wherein said circuit means comprises:

source means for supplying a source of electrical energy to said motor means;

means coupled to said first switch means for reversing the turning direction of said motor means from said normal predetermined turning movement in response to operative engagement of said ball return means with said first switch means; and main switch means for electrically coupling said source means to said motor means.

31. An apparatus as in claim 30 further comprising speed control means electrically coupled to said motor means for controlling the rate of turning movement of said sweep arm.

32. An apparatus as in claim 30 further comprising:

means coupled to said second switch means for deactivating said motor means in response to operative engagement of said ball return means with said second switch means; and means coupled to said second switch means for returning said motor means to said normal predetermined turning direction of movement in response to operative engagement of said ball return means with said second switch means.

* * * * *